US008661632B2

(12) United States Patent
Dey et al.

(10) Patent No.: US 8,661,632 B2
(45) Date of Patent: Mar. 4, 2014

(54) METHOD AND APPARATUS FOR PLIABILIZING KNITTED OR WOVEN MATERIALS

(75) Inventors: Clifford A. Dey, Riegelsville, PA (US); Dwayne Looney, Flemington, NJ (US)

(73) Assignee: Ethicon, Inc., Somerville, NJ (US)

( * ) Notice: Subject to any disclaimer, the term of this patent is extended or adjusted under 35 U.S.C. 154(b) by 340 days.

(21) Appl. No.: 13/240,447

(22) Filed: Sep. 22, 2011

(65) Prior Publication Data

US 2013/0074297 A1 Mar. 28, 2013

(51) Int. Cl.
*D06C 5/00* (2006.01)

(52) U.S. Cl.
USPC ..... 26/80; 26/83

(58) Field of Classification Search
USPC ..... 26/80, 83, 84, 85, 81, 72, 82, 71; 66/152, 149 R, 150
See application file for complete search history.

(56) References Cited

U.S. PATENT DOCUMENTS

| | | | | | |
|---|---|---|---|---|---|
| 625,169 | A | * | 5/1899 | Johnston | 26/81 |
| 1,280,607 | A | | 10/1918 | Widdowson | |
| 1,775,894 | A | | 9/1930 | Drabble | |
| 2,045,755 | A | * | 6/1936 | Cohn | 8/151 |
| 2,590,938 | A | * | 4/1952 | Cohn et al. | 26/84 |
| 2,750,649 | A | * | 6/1956 | Johnson | 26/81 |
| 3,474,755 | A | * | 10/1969 | Voo | 118/44 |
| 3,616,502 | A | * | 11/1971 | Aronoff | 26/85 |
| 3,678,545 | A | * | 7/1972 | Hino et al. | 26/85 |
| 3,978,557 | A | * | 9/1976 | Goodson | 26/84 |
| 4,269,046 | A | * | 5/1981 | Strahm et al. | 68/13 R |
| 5,519,922 | A | * | 5/1996 | Strudel | 26/85 |
| 5,884,376 | A | * | 3/1999 | Bertoldo | 26/80 |
| 5,884,377 | A | * | 3/1999 | Rutz et al. | 26/85 |
| 6,601,412 | B1 | * | 8/2003 | Quay et al. | 66/152 |

FOREIGN PATENT DOCUMENTS

| | | |
|---|---|---|
| GB | 251548 | 5/1926 |
| GB | 282896 | 1/1928 |
| WO | WO 2004/045663 | 6/2004 |

* cited by examiner

*Primary Examiner* — Amy Vanatta

(57) ABSTRACT

An apparatus for pliabilizing tubular materials including a frame, a ring holder, and a mandrel assembly. The ring holder assembly is mounted to the frame and includes a circumferential ring, and a plurality of pairs of non-mechanically driven, rotatable wheels mounted around the ring and having a recess extending circumferentially around an outer edge. The mandrel assembly includes a mandrel having proximal and distal ends and a maximum outer circumference, and a plurality of non-mechanically driven, rotatable wheels spaced apart about a circumference of the mandrel and mounted thereto so as to extend radially beyond the maximum outer circumference. The wheels of the mandrel assembly are positioned between and so as to mate with respective pairs of the wheels of the ring holder assembly, and the wheels of the mandrel assembly are sized shaped to mate with the recesses of the respective pairs of wheels of the ring holder assembly.

22 Claims, 9 Drawing Sheets

METHOD AND APPARATUS FOR PLIABILIZING KNITTED OR WOVEN MATERIALS

FIELD OF THE INVENTION

The present invention relates generally to the manufacture of knitted or woven fabrics or materials, and more particularly to a method and apparatus for pliabilizing continuous knitted or woven tubular structures.

BACKGROUND

Pliabilization, as the term is used herein, refers to the process of stretching a knitted or woven structure in one or more directions so that the structure's dimension in that direction(s) is increased. For such knitted or woven structures, the increased dimension may result in a decrease in material thickness and/or an increase in pore size.

There many applications where pliabilizing a knitted or woven structure is desirable or necessary. For example, materials made of polysaccharides (which include cellulose based materials such as rayon, cotton, oxidized cellulose, ORC, etc.) are subject to shrinkage during processing or exposure to moisture, which makes the material less flexible. Pliabilization is needed for such materials in order to render the material less stiff and thereby useful for its intended purpose or application. In the case of ORC fabric, a benefit of pliabilization is to open the pore structure of the material to enable a more efficient drying step.

It is important to assure that pliabilization is achieved uniformly and in all directions. If pliabilization is not uniform, sections of the material may need to be removed and discarded to assure that the remaining material has uniform properties in all directions. If not, product performance may be affected.

When considering tubular knitted or woven structures, it is known to pass the tubular "socks" over enlarged apparatus to radially expand or stretch the sock. In many known devices, however, the enlarged apparatus is mounted in such a manner that continuous feed over it is impossible. Rather, the length of the sock that can be passed over the mandrel is limited due to the physical interference of the mounting mechanism. Another known prior art system is shown in FIGS. 1*a* and 1*b*, which includes opposing rings 10 held in place between respective pairs of cone shaped pins 12. As shown in FIG. 1*b*, the sock 14 is stretched as it is fed over the rings. This system, however, does not stretch the material equally around the circumference of the sock, but rather results in non-uniform, primarily two dimensional stretching. At least some known devices have attempted to address the issue of achieving radial stretching and continuous feed for stretching tubular fabrics. These devices are set forth in U.S. Pat. No. 1,775,894 and GB Patent No. 282,896. These disclosed machines are large and cumbersome, and rely on a series of sets of rotating wheels e extending along a relatively long pathway, as shown in FIG. 5 of the '894 patent. The disclosed machine also is not likely to result in uniform stretching, as the fabric will stretch and un-stretch repeatedly both as it passes successively from one set of wheels to the next, and also as between the circumferential wheels of any given set. Further, the disclosed stretching apparatus requires a large and cumbersome mounting mechanism to maintain its position relative to the frame as the fabric is passed over it.

Another disadvantage of the prior art devices described above is that the wheels over which the fabric is drawn for stretching are mechanically driven to assist in passing the fabric over them, which also results in less uniform stretching as the speed and/or tension placed on the fabric fluctuates over the course of the process.

The present invention provides a new and improved apparatus for pliabilizing continuous tubular knitted or woven structures in a uniform manner.

SUMMARY OF THE INVENTION

The present invention provides an apparatus for pliabilizing tubular materials including a frame, a ring holder assembly mounted to the frame that includes a circumferential ring and a plurality of pairs of non-mechanically driven, rotatable wheels spaced circumferentially around said ring and mounted thereto. Each wheel has a recess extending circumferentially around an outer edge thereof. The apparatus further includes a mandrel assembly including a mandrel with proximal and distal ends and a maximum outer circumference, and a plurality of non-mechanically driven, rotatable wheels spaced apart about a circumference of the mandrel. The wheels of the mandrel assembly are at a location spaced apart from the proximal end and mounted thereto so as to extend radially beyond the maximum outer circumference. The wheels of the mandrel assembly are positioned between and so as to mate with respective pairs of the wheels of the ring holder assembly, and wherein the wheels of the mandrel assembly are sized shaped so that an outer edge thereof fits within the recesses of the respective pairs of wheels of the ring holder assembly.

The apparatus may further include a second ring holder assembly mounted to the frame, wherein the second ring holder assembly includes a circumferential ring and a plurality of pairs of non-mechanically driven, rotatable wheels spaced circumferentially around the ring and mounted to the ring. Each wheel has a recess extending circumferentially around an outer edge thereof. It may also include a second mandrel assembly including a mandrel with proximal and distal ends and a maximum outer circumference, and a plurality of non-mechanically driven rotatable wheels spaced apart about said circumference of the mandrel at a location spaced apart from the proximal end and mounted thereto so as to extend radially beyond said maximum outer circumference. The wheels of the second mandrel assembly are positioned between and so as to mate with respective pairs of the wheels of the second ring holder assembly, and the wheels of the second mandrel assembly are sized and shaped so that an outer edge thereof fits within the recesses of the respective pairs of wheels of the second ring holder assembly. The second ring holder assembly and second mandrel assembly are mounted on the frame at a location relative to the first ring holder assembly and first mandrel assembly so that a tubular material to be pliabilized can be passed circumferentially over the first and second mandrel assemblies in succession.

In another embodiment, the apparatus further includes at least one pair of mechanically driven rollers positioned adjacent one another and each having a longitudinal axis positioned substantially perpendicular to a longitudinal axis of said mandrel and spaced apart from a distal end of said mandrel. The at least one pair of drive rollers may be adapted to drive continuous movement of a tubular material to be pliabilized that is passed circumferentially over the mandrel and between the pair of rollers.

The material to be pliabilized may contain oxidized regenerated cellulose.

In others embodiment, the distal end of the mandrel is approximately six inches in diameter and/or the proximal end of the mandrel is approximately three inches in diameter. The apparatus may further include at least eight wheels.

In yet another embodiment, the mandrel is substantially cone-shaped, having an outer diameter continuously increasing in size from the proximal end to the distal end. Alternatively, the mandrel may have a substantially spherical or hemispherical shape, or a substantially elliptical in shape.

Also provided is an apparatus for pliabilizing tubular materials including a frame, a ring holder assembly mounted to the frame, wherein the ring holder assembly includes a circumferential ring and a plurality of pairs of non-mechanically driven, rotatable wheels spaced circumferentially around said ring and mounted thereto, and a mandrel assembly including a mandrel having proximal and distal ends and a maximum outer circumference, and a plurality of non-mechanically driven, rotatable wheels spaced apart about a circumference of the mandrel at a location spaced apart from the proximal end and mounted thereto so as to extend radially beyond said maximum outer circumference. The wheels of the mandrel assembly are positioned between and substantially adjacent to the respective pairs of the wheels of the ring holder assembly to thereby maintain the position of the mandrel assembly relative to the ring holder assembly and frame without any further structural support.

The apparatus may further include a tubular material to be pliabilized, wherein the tubular material is adapted to pass over the mandrel and between the adjacent wheels of the ring holder assembly and mandrel assembly. The tubular material may be a continuous tubular knit structure, and may contain oxidized regenerated cellulose.

In alternate embodiments, the distal end of the mandrel is approximately six inches in diameter and/or the proximal end of the mandrel is approximately three inches in diameter. The mandrel may further have at least eight wheels.

In yet another embodiment, the mandrel is substantially cone-shaped, having an outer diameter continuously increasing in size from the proximal end to the distal end.

In yet another embodiment, each wheel of the ring holder assembly further includes a recess extending circumferentially around an outer edge thereof, and the wheels of the mandrel assembly are sized and shaped so that an outer edge thereof fits within the recesses of the respective pairs of wheels of the ring hold assembly.

According to yet another embodiment, the apparatus further includes a second ring holder assembly mounted to the frame, wherein the second ring holder assembly includes a circumferential ring, and a plurality of pairs of non-mechanically driven, rotatable wheels spaced circumferentially around said ring and mounted thereto, and a second mandrel assembly including a second mandrel having proximal and distal ends and a maximum outer circumference, and a plurality of non-mechanically driven, rotatable wheels spaced apart about a circumference of the mandrel at a location spaced apart from the proximal end and mounted thereto so as to extend radially beyond said maximum outer circumference. The wheels of the second mandrel assembly are positioned between and substantially adjacent to the respective pairs of the wheels of the second ring holder assembly to thereby maintain the position of the second mandrel assembly relative to the second ring holder assembly and frame without any further structural support.

In yet another embodiment, each wheel of the first and second ring holder assemblies further includes a recess extending circumferentially around an outer edge thereof, and wherein the wheels of the first and second mandrel assemblies are sized and shaped so that an outer edge thereof fits within the recesses of the respective pairs of wheels of the first and second ring hold assemblies.

These and other objects, features and advantages of the present invention will be apparent from the following detailed description of illustrative embodiments thereof, which is to be read in connection with the accompanying drawings.

DETAILED DESCRIPTION

Figure 1A:
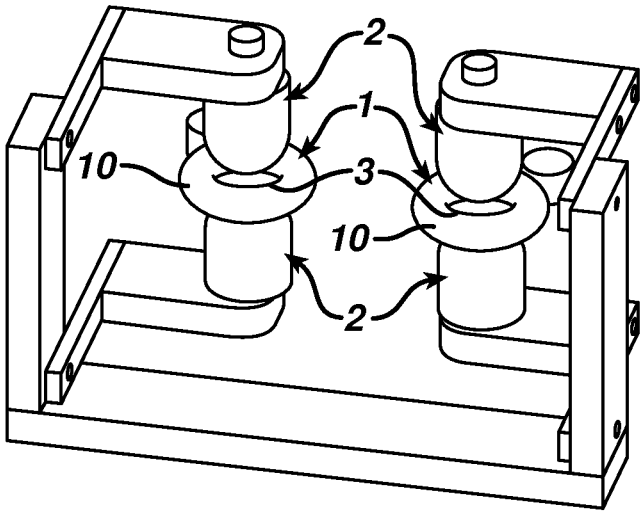
FIG. 1A PRIOR ART
FIGS. 1*a* and 1*b* illustrate a prior art device for pliabilizing tubular material.
Figure 1B:
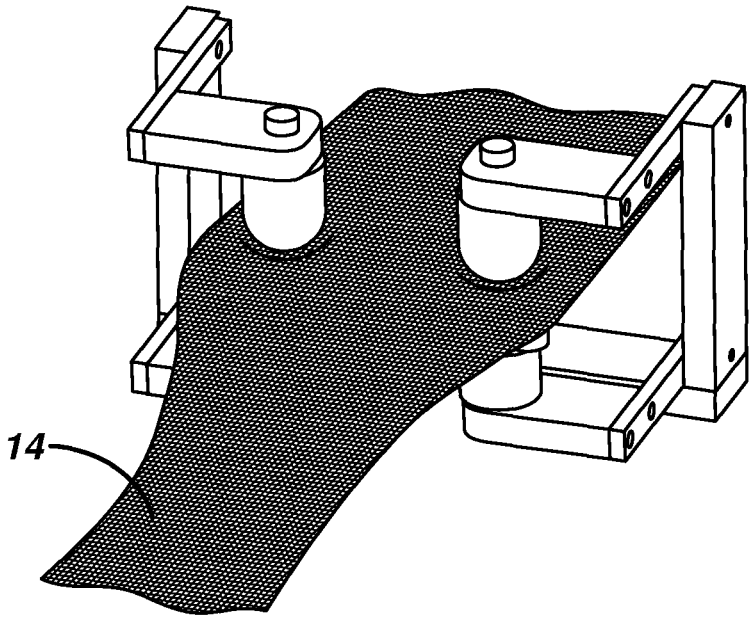
FIG. 1B PRIOR ART
Figure 2A:
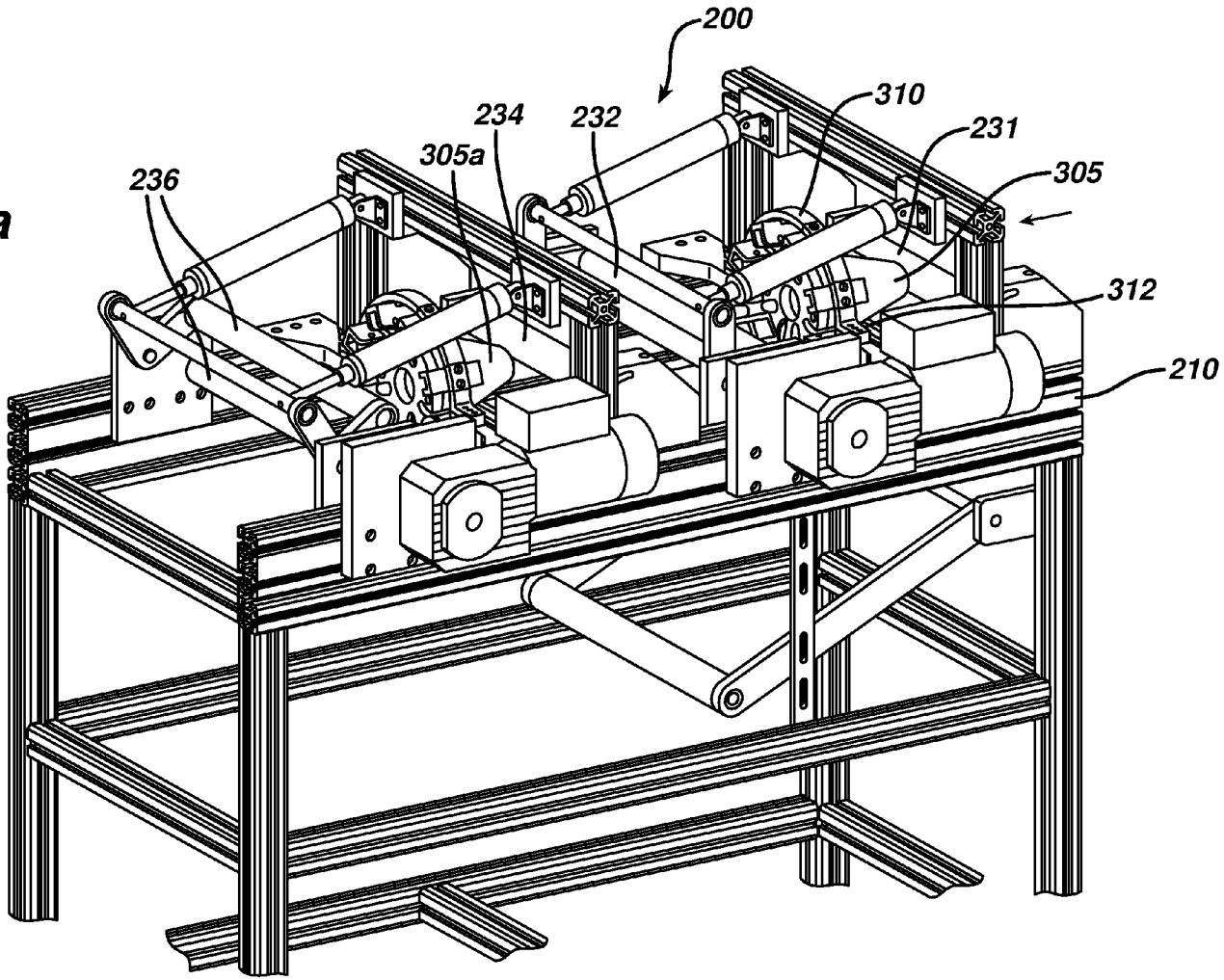
FIGS. 2*a* and 2*b* illustrate an apparatus for pliabilizing tubular material according to the present invention.
Figure 2B:
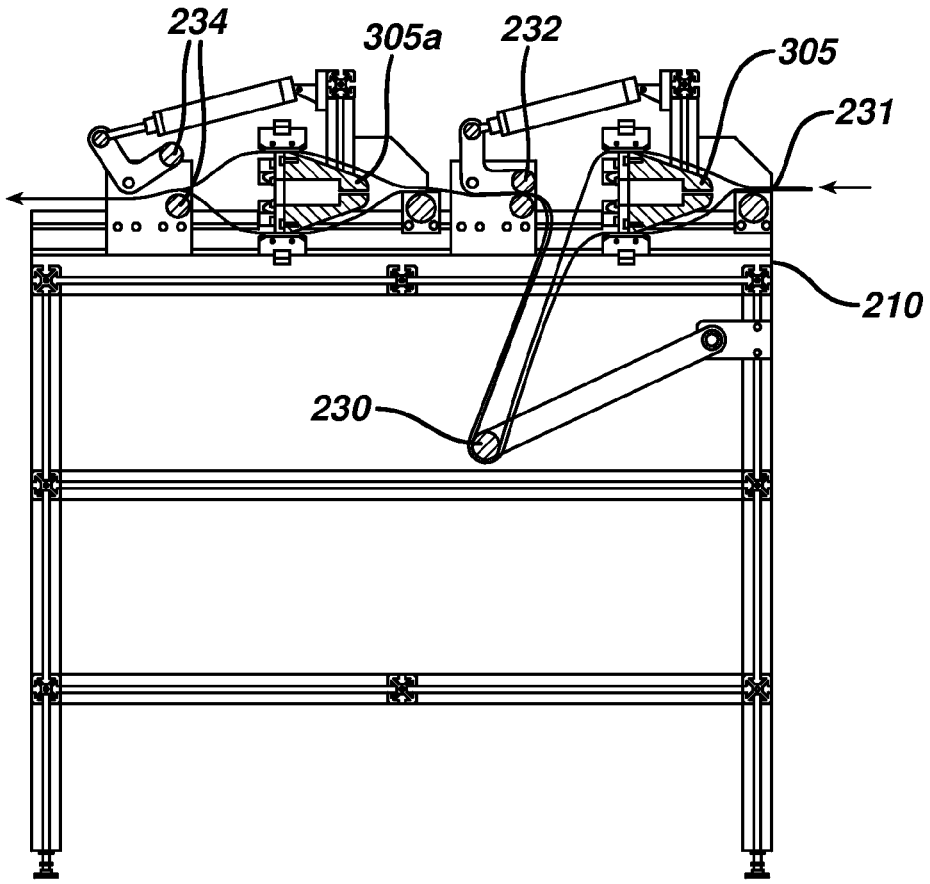

FIGS. 2*a* and 2*b* illustrate an apparatus for pliabilizing tubular materials according to the present invention. The apparatus 200 includes a stationary frame 210 or the like, that may be of any suitable type and that further may be configured to stand on the ground (as shown) or on a table top or any suitable stationary surface. A tubular material is fed through the apparatus in the pathway indicated by the arrows in FIG. 2*b*. The tubular material is fed over a first roller 231, and passed circumferentially over the mandrel 305, which is shown in greater detail in FIGS. 3 and 4. Once passed over the mandrel 305, the tubular material passes over pivot arm 230 and then between a first set of drive rollers 232, which are mechanically driven to assist in passing the material through the apparatus. In a preferred embodiment, the assembly includes a second mandrel 305*a*, and the material is fed over a second roller 234, over the second mandrel 305*a* and through a second set of drive rollers 236 before exiting the apparatus. Use of the second mandrel serves to further ensure consistent and even pliabilization of the fabric.

FIGS. 3-6 illustrate in greater detail the combination ring holder assembly 306 and mandrel assembly 304. The mandrel assembly is shown in greater detail in FIG. 4, and includes a mandrel 305 and multiple wheels 308 spaced circumferentially around the distal end of the mandrel. Although the illustrated mandrel is cone shaped, various other shapes may be utilized as well, such as spherical, elliptical, football-like etc, provided that the wheels extend radially beyond a maximum outer circumference of the mandrel. Preferably, the outer circumference of the mandrel increases from its proximal end 311 to distal end 309. The number of wheels is determined by the circumference of the maximum outer circumference of the mandrel, which itself is determined by the type and dimensions of the tubular knitted or woven material that is being pliabilized, and the amount of pliabilization desired. This may be determined, for example, by determining the amount of stretch needed to break any surface bonds without weakening individual strands. In one embodiment, the material to be pliabilized is an oxidized regenerated cellulose tubular knit structure, and the diameter of the distal end of the mandrel is approximately six inches, with the 8 wheels (described below) extending outwardly by an additional approximately ⅛ inch. The proximal end 311 of the mandrel is also sized and shaped so that the proximal end of the tubular material 301 can be easily started by pulling it over the proximal end as illustrated in FIG. 7. Further, the diameter of the proximal end of the mandrel is approximately 3 inches and its length l approximately 8 inches. After pulling the material over the proximal end of the mandrel, the material is fed over the mandrel wheels 308 as indicated by the arrows in FIG. 7.

Figure 3:
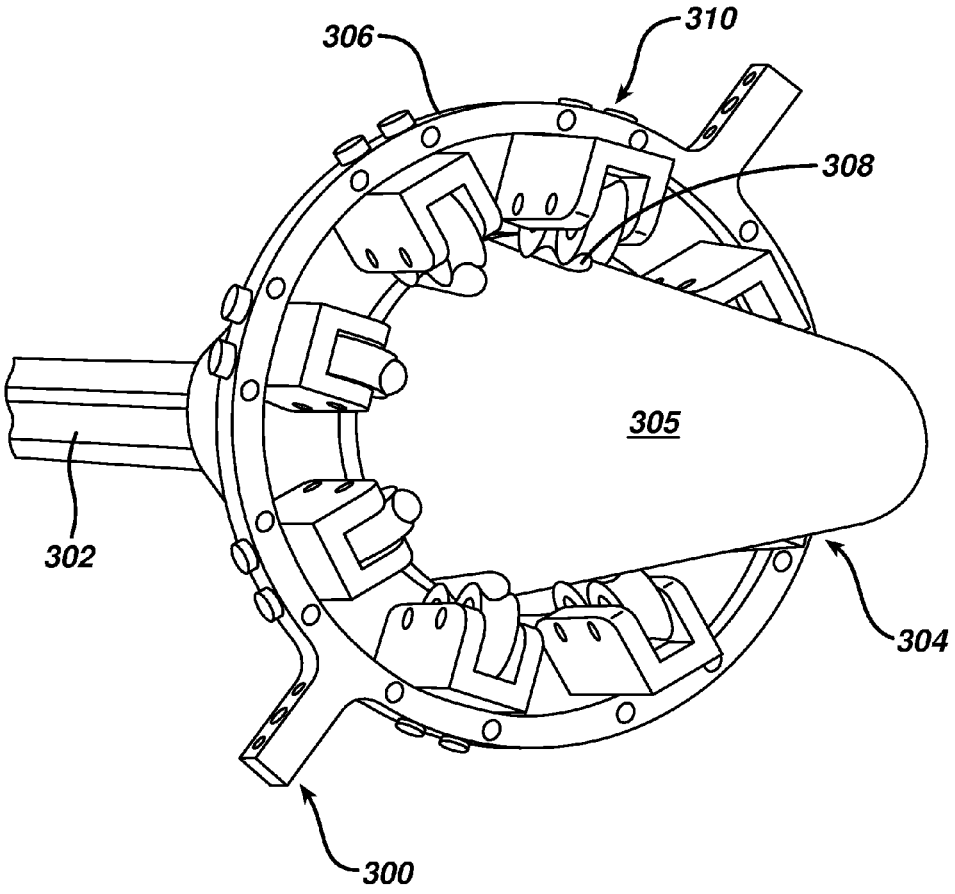
FIG. 3 is an enlarged view of a combination ring holder assembly and mandrel assembly according to the present invention.
Figure 4:
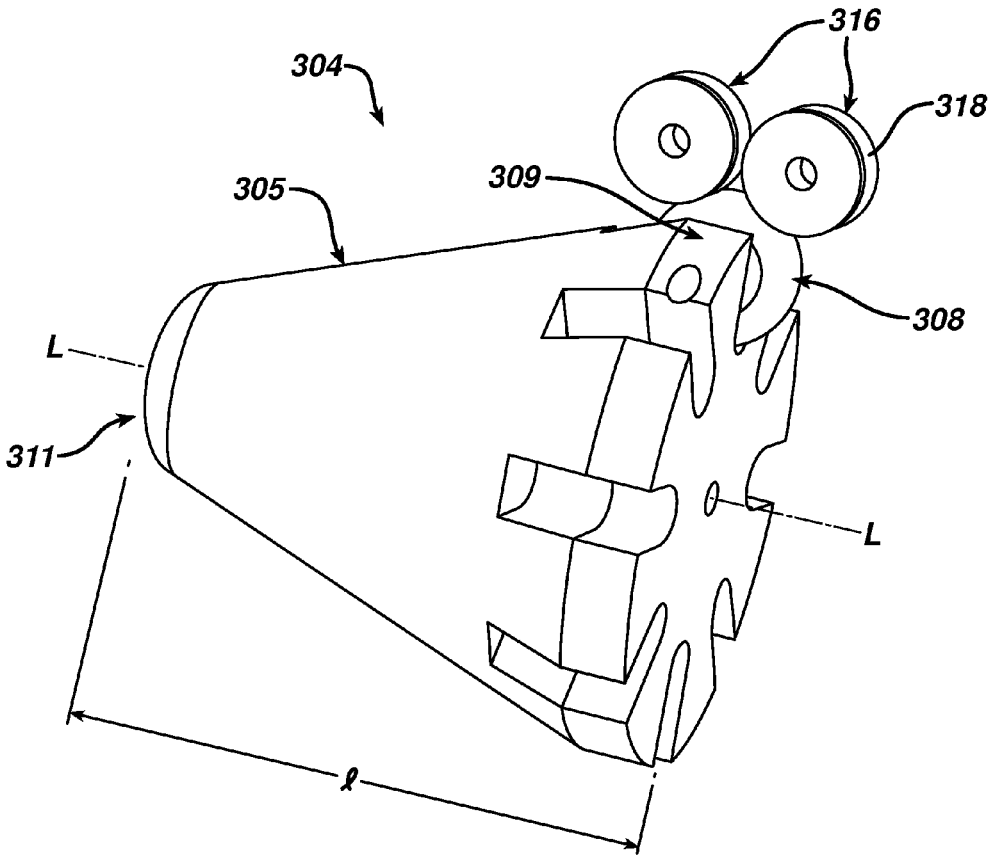
FIG. 4 illustrates components of the mandrel assembly of FIG. 3 in greater detail.
Figure 5:
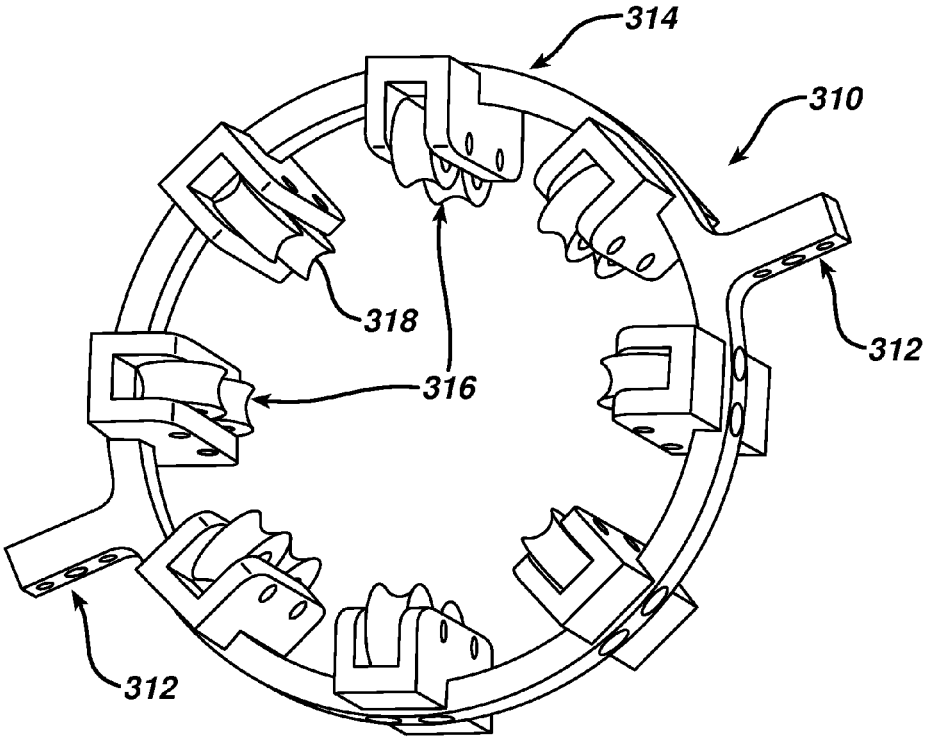
FIG. 5 illustrates the ring holder assembly of FIG. 3 in greater detail.
Figure 6:
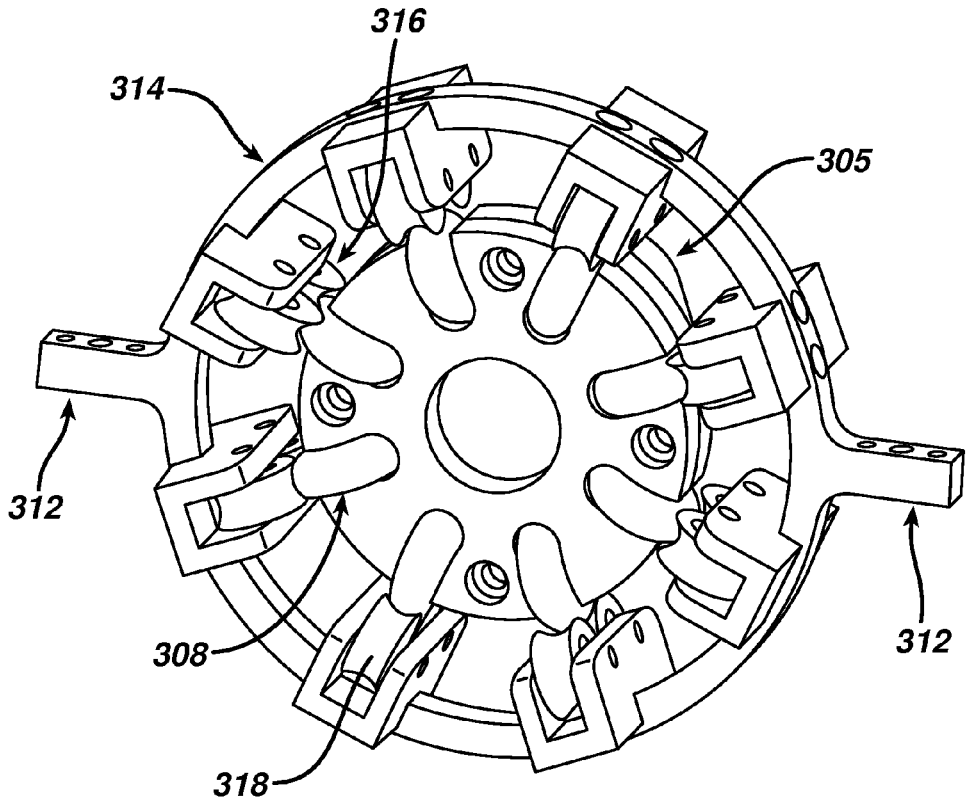
FIG. 6 is a perspective view of the combination assembly of FIG. 3.
Figure 7:
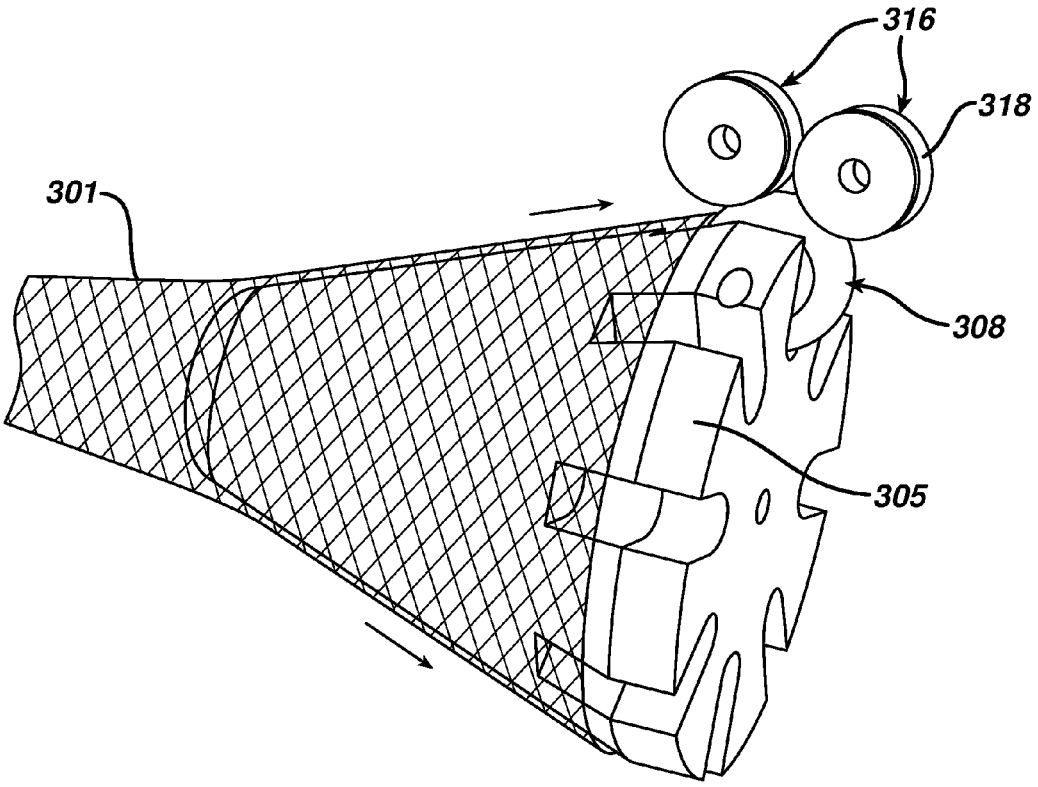
FIG. 7 illustrates the combination assembly of FIG. 3 in combination with a tubular material.

The mandrel assembly is mounted within the ring holder assembly 310 as shown in FIGS. 3 and 6. The ring holder assembly 310 is mounted to the machine's frame 210 by one or more mounting flanges 312. As shown in detail in FIG. 5, the ring holder assembly includes a circumferential frame 314 to which multiple, circumferentially spaced apart, pairs of wheels 316 are mounted. The wheels of each pair preferably extend inwardly from the circumferential frame, and spin in a direction along the longitudinal axis L-L of the mandrel. The pairs of wheels 316 are positioned so as to each align with a respective wheel 308 of the mandrel assembly, with the wheels 308 of the mandrel assembly positioned between, but in circumferential contact with both wheels of pair 316 as shown in FIG. 6. When mounted in this manner, the tubular material is positioned between the wheels 308 of the mandrel assembly and the wheels 316 of the ring holder assembly. In a preferred embodiment, the wheels 308 of the mandrel assembly are further sized and shaped so that they mate with recesses 318 extending around the circumference of the ring holder assembly wheels 316.

Wheels 308 and 316 rotate passively as the tubular material is passed therebetween. The mating of wheel 308 between respective wheel pairs 316 serves to hold the mandrel from moving in either the proximal or distal directions as the material is passed over the mandrel, and allows the mandrel to be "free floating", or free from any further attachment to the machinery. This enables a tubular material of infinite length to be drawn over the relatively small mandrel, allowing for much greater manufacturing flexibility, and greater efficiency.

Further, with passive rotating wheels, the wheels are entirely driven by the friction of the fabric being pulled across/over the wheels, and not by any other mechanical forces. This eliminates the potential risk of contamination from foreign matter being deposited on the material by a drive mechanism, and also allows for variations in the material, such as rips. tears, runs, hard spots and the like, and allows the material to expand and contract independently preventing binding of the material which can lead to an increase in damage to the textile structure. The current embodiment further allows for variations in the material due to moisture content, knit structure variation and other mechanical attributes related to the textile structure and its manufacture, and further increases the maximum yield from each inch of textile structure. Finally, the process described herein increases the ability of the textile structure to be further processed, and also increases throughput speed of downstream process.

Although illustrative embodiments of the present invention have been described herein with reference to the accompanying drawings, it is to be understood that the invention is not limited to those precise embodiments and that various other changes and modifications may be effected herein by one skilled in the art without departing from the scope or spirit of the invention.

What is claimed is:

1. An apparatus for pliabilizing tubular materials comprising:

a frame;

a ring holder assembly mounted to the frame, wherein the ring holder assembly includes a circumferential ring, and a plurality of pairs of non-mechanically driven, rotatable wheels spaced circumferentially around said ring and mounted thereto, each wheel having a recess extending circumferentially around an outer edge thereof; and a mandrel assembly including a mandrel having proximal and distal ends and a maximum outer circumference, and a plurality of non-mechanically driven, rotatable wheels spaced apart about a circumference of the mandrel at a location spaced apart from the proximal end and mounted thereto so as to extend radially beyond said maximum outer circumference;

wherein the wheels of the mandrel assembly are positioned between and so as to mate with respective pairs of the wheels of the ring holder assembly, and wherein the wheels of the mandrel assembly are sized and shaped so that an outer edge thereof fits within the recesses of the respective pairs of wheels of the ring holder assembly.

2. The apparatus according to claim 1, further comprising:

a second ring holder assembly mounted to the frame, wherein the second ring holder assembly includes a circumferential ring, and a plurality of pairs of non-mechanically driven, rotatable wheels spaced circumferentially around said ring and mounted to said ring, each wheel having a recess extending circumferentially around an outer edge thereof; and a second mandrel assembly including a mandrel having proximal and distal ends and a maximum outer circumference, and a plurality of non-mechanically driven rotatable wheels spaced apart about said circumference of the mandrel at a location spaced apart from the proximal end and mounted thereto so as to extend radially beyond said maximum outer circumference;

wherein the wheels of the second mandrel assembly are positioned between and so as to mate with respective pairs of the wheels of the second ring holder assembly, and wherein the wheels of the second mandrel assembly are sized and shaped so that an outer edge thereof fits within the recesses of the respective pairs of wheels of the second ring holder assembly, and wherein the second ring holder assembly and second mandrel assembly are mounted on the frame at a location relative to the first ring holder assembly and first mandrel assembly so that a tubular material to be pliabilized can be passed circumferentially over the first and second mandrel assemblies in succession.

3. The apparatus according to claim 1, further comprising at least one pair of mechanically driven rollers positioned adjacent one another and each having a longitudinal axis positioned substantially perpendicular to a longitudinal axis of said mandrel and spaced apart from a distal end of said mandrel.

4. The apparatus according to claim 3, wherein the at least one pair of drive rollers is adapted to drive continuous movement of a tubular material to be pliabilized that is passed circumferentially over said mandrel and between said pair of rollers.

5. The apparatus according to claim 4, wherein the material to be pliabilized contains oxidized regenerated cellulose.

6. The apparatus according to claim 1, wherein the distal end of the mandrel is approximately six inches in diameter.

7. The apparatus according to claim 6, wherein the proximal end of the mandrel is approximately three inches in diameter.

8. The apparatus according to claim 7, wherein the mandrel assembly has at least eight wheels.

9. The apparatus according to claim 1, wherein the mandrel is substantially cone-shaped, having an outer diameter continuously increasing in size from the proximal end to the distal end.

10. The apparatus according to claim 1, wherein the mandrel has a substantially spherical or hemispherical shape.

11. The apparatus according to claim 1, wherein the mandrel is substantially elliptical in shape.

12. An apparatus for pliabilizing tubular materials comprising:

a frame;

a ring holder assembly mounted to the frame, wherein the ring holder assembly includes a circumferential ring, and a plurality of pairs of non-mechanically driven, rotatable wheels spaced circumferentially around said ring and mounted thereto; and a mandrel assembly including a mandrel having proximal and distal ends and a maximum outer circumference, and a plurality of non-mechanically driven, rotatable wheels spaced apart about a circumference of the mandrel at a location spaced apart from the proximal end and mounted thereto so as to extend radially beyond said maximum outer circumference;

wherein the wheels of the mandrel assembly are positioned between and substantially adjacent to the respective pairs of the wheels of the ring holder assembly to thereby maintain the position of the mandrel assembly relative to the ring holder assembly and frame without any further structural support.

13. The apparatus according to claim 12, further comprising a tubular material to be pliabilized, wherein the tubular material is adapted to pass over the mandrel and between the adjacent wheels of the ring holder assembly and mandrel assembly.

14. The apparatus according to claim 13, wherein the tubular material is a continuous tubular knit structure.

15. The apparatus according to claim 14, wherein the tubular knit structure contains oxidized regenerated cellulose.

16. The apparatus according to claim 12, wherein the distal end of the mandrel is approximately six inches in diameter.

17. The apparatus according to claim 16, wherein the proximal end of the mandrel is approximately three inches in diameter.

18. The apparatus according to claim 17, wherein the mandrel assembly has at least eight wheels.

19. The apparatus according to claim 12, wherein the mandrel is substantially cone-shaped, having an outer diameter continuously increasing in size from the proximal end to the distal end.

20. The apparatus according to claim 12, wherein each wheel of the ring holder assembly further comprises a recess extending circumferentially around an outer edge thereof, and wherein the wheels of the mandrel assembly are sized and shaped so that an outer edge thereof fits within the recesses of the respective pairs of wheels of the ring holder assembly.

21. The apparatus according to claim 12, further comprising:

a second ring holder assembly mounted to the frame, wherein the second ring holder assembly includes a circumferential ring, and a plurality of pairs of non-mechanically driven, rotatable wheels spaced circumferentially around said ring and mounted thereto; and a second mandrel assembly including a second mandrel having proximal and distal ends and a maximum outer circumference, and a plurality of non-mechanically driven, rotatable wheels spaced apart about a circumference of the mandrel at a location spaced apart from the proximal end and mounted thereto so as to extend radially beyond said maximum outer circumference;

wherein the wheels of the second mandrel assembly are positioned between and substantially adjacent to the respective pairs of the wheels of the second ring holder assembly to thereby maintain the position of the second mandrel assembly relative to the second ring holder assembly and frame without any further structural support.

22. The apparatus according to claim 21, wherein each wheel of the first and second ring holder assemblies further comprises a recess extending circumferentially around an outer edge thereof, and wherein the wheels of the first and second mandrel assemblies are sized and shaped so that an outer edge thereof fits within the recesses of the respective pairs of wheels of the first and second ring holder assemblies.

* * * * *